United States Patent [19]

Knecht

[11] Patent Number: 4,648,236

[45] Date of Patent: Mar. 10, 1987

[54] PACKAGING MACHINE INCLUDING A FOLDING, SEALING AND CONVEYING APPARATUS

[75] Inventor: Alfred Knecht, Neuhausen am Rheinfall, Switzerland

[73] Assignee: SIG Schweizerische Industrie-Gesellschaft, Neuhausen am Rheinfall, Switzerland

[21] Appl. No.: 857,111

[22] Filed: Apr. 29, 1986

[30] Foreign Application Priority Data

Apr. 30, 1985 [CH] Switzerland ..... 1874/85

[51] Int. Cl.[4] ..... B65B 11/23

[52] U.S. Cl. ..... 53/234; 53/253

[58] Field of Search ..... 53/579, 225, 234, 253

[56] References Cited

U.S. PATENT DOCUMENTS

| | | | |
|---|---|---|---|
| 353,866 | 12/1886 | Kinney | 53/234 X |
| 1,313,863 | 8/1919 | Smith | 53/234 |
| 2,991,605 | 7/1961 | Pollmann | 53/253 X |
| 3,978,639 | 9/1976 | Ferrozzi | 53/234 X |

OTHER PUBLICATIONS

SIG Schweizerische Industrie-Gesellschaft, Specification Sheet DKN 0484.

*Primary Examiner*—John Sipos

*Attorney, Agent, or Firm*—Spencer & Frank

[57] ABSTRACT

A packaging machine has, for wrapping flat, rectangular items in a wrapper sheet, a folding, sealing and conveying apparatus including an intermittently driven turntable, a plurality of pocket assemblies on the turntable, a charging station for radially introducing an article with a wrapper sheet in between first and second walls of a pocket assembly dwelling in the charging station, a sealing station for providing a longitudinal fin seal on previously superposed flaps of the wrapper sheet, and a discharge station for radially ejecting the article from the pocket assembly dwelling in the discharge station. There is further provided an extension affixed to the first wall of each pocket assembly at an angle to the first wall. Each extension has a support face cooperating with the sealing shoe of the sealing station as a countersupport. The apparatus also has a device for rotating each pocket assembly approximately 180° relative to the turntable for setting each extension into a radially relatively outward position in the charging station and a radially relatively inward position in the discharge station.

13 Claims, 6 Drawing Figures

Z
III
IV
V
3
4
10
11
20
21
22
25
26
27
27'
28
28'
29
30
31
32
33
34
35
44
45
47
48
49
51
52
53
54
55
56
57
61
62

PACKAGING MACHINE INCLUDING A FOLDING, SEALING AND CONVEYING APPARATUS

BACKGROUND OF THE INVENTION

This invention relates to a packaging machine for individually wrapping rectangular flat articles, such as chocolate bars, and is particularly concerned with a folding, sealing and conveying apparatus incorporated in such a machine. The apparatus includes a stepwise operated turntable provided with a plurality of receiving pockets into which an article is, together with a wrapper piece, introduced in a charging station approximately in a radial direction relative to the turntable and from which the article may be radially pushed out in a discharge station. Each pocket has a first and a second wall which cooperate with the opposite large faces of the article and which are oriented approximately radially in the charging station and in the discharge station. Adjacent the turntable there is further provided at least one sealing station which includes a sealing device having a sealing shoe for forming a longitudinal fin seal on the wrapper. Between the charging station and the sealing station there is provided a folding mechanism to fold onto one another those flaps of the wrapper material which are to form the longitudinal fin seal.

An apparatus of the above-outlined type is known and is shown, for example, in the flyer DKN 0484 by SIG Schweizerische Industrie-Gesellschaft, Neuhausen am Rheinfall, Switzerland. The known apparatus serves for the wrapping of chocolate bars with a wrapper and to form a longitudinal fin seal thereon. As the turntable rotates and the respective pockets with the chocolate bar and the wrapper material move towards a sealing station, the two relatively narrow wrapper flaps which are to constitute the longitudinal fin seal are folded to one another on the narrow side of a first wall of the respective pocket. In the sealing station the fin seal is formed by a heated sealing shoe. Upon further rotation of the turntable, the wrapped article, carried in the respective pocket, reaches a discharge station from which the article is pushed out of the pocket. During this occurrence, the two flaps constituting the fin seal are folded flat onto one of the large faces of the chocolate bar. Lateral seals or closures are formed in successive apparatuses.

The above-outlined apparatus operates in a satisfactory manner provided that the wrapper flaps are relatively narrow and in the successive folding operations they need not first extend away from the article. Such apparatus, however, is not adapted for relatively wide flaps because the flaps may wrinkle before they reach the sealing station and thus a hermetic seal is not achieved, and further, because in the discharge station the articles may be pushed out of the turntable pocket in an orientation which is unfavorable for the successive folding operation.

SUMMARY OF THE INVENTION

It is an object of the invention to provide an improved apparatus of the above-outlined type from which the discussed disadvantages are eliminated and in which thus articles may be wrapped in foil such that for the fin seal a relatively wide flap is formed which, upon ejection of the article from the turntable pocket in the discharge station, is in a favorable position for further processing.

This object and others to become apparent as the specification progresses, are accomplished by the invention, according to which, briefly stated, the first pocket wall has an angularly offset extension functioning as a countersupport for the sealing shoe and further, the folding mechanism is adapted to fold the two flaps in a superposed condition onto the extension and further, pivotal means are provided which cause a pivotal motion of the pockets between the sealing station and the discharge station through an angle of approximately 180° relative to the turntable.

By virtue of the angularly offset extension, even a relatively wide flap may be supported in a reliable manner without the risks of wrinkling so as to ensure a satisfactory hermetic seal. By pressing the sealing shoe against the extension, functioning as a countersupport, only the sealing shoe needs to be moved during the sealing operation and the extent of its displacement may be very small. This permits short operating periods, resulting in a high output of the machine. By rotating the pockets about approximately 180° before reaching the discharge station, the fin seal is situated in the rear as viewed in the direction of ejection, so that in a successive folding operation which, for example, may be performed with an apparatus having a pocket-equipped turntable, the fin seal is readily accessible by a grasping mechanism.

DESCRIPTION OF THE PREFERRED EMBODIMENTS

Figure 1:
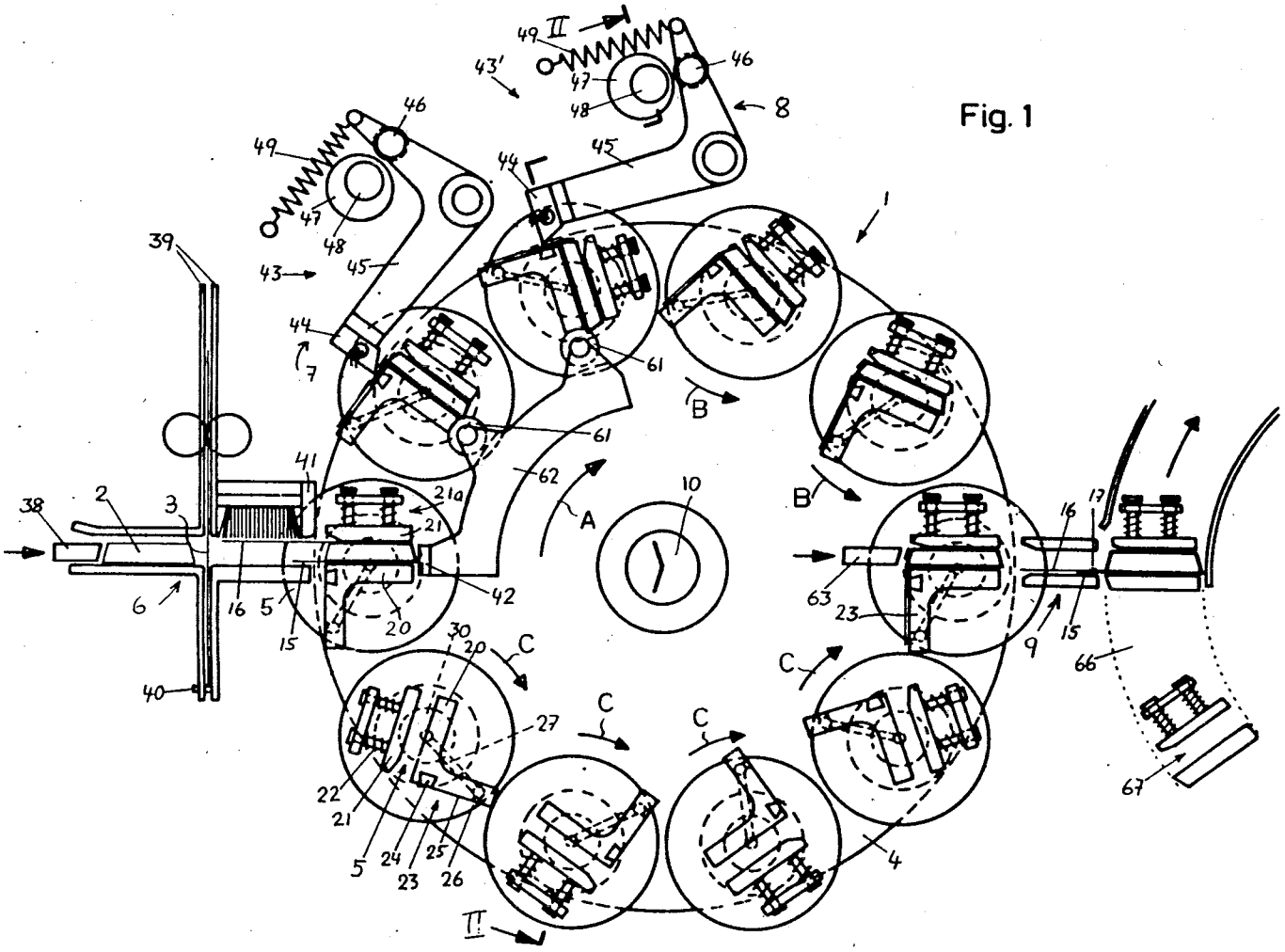
FIG. 1 is a top plan view (direction Z in FIG. 2) of a preferred embodiment of the invention.
Figure 2:
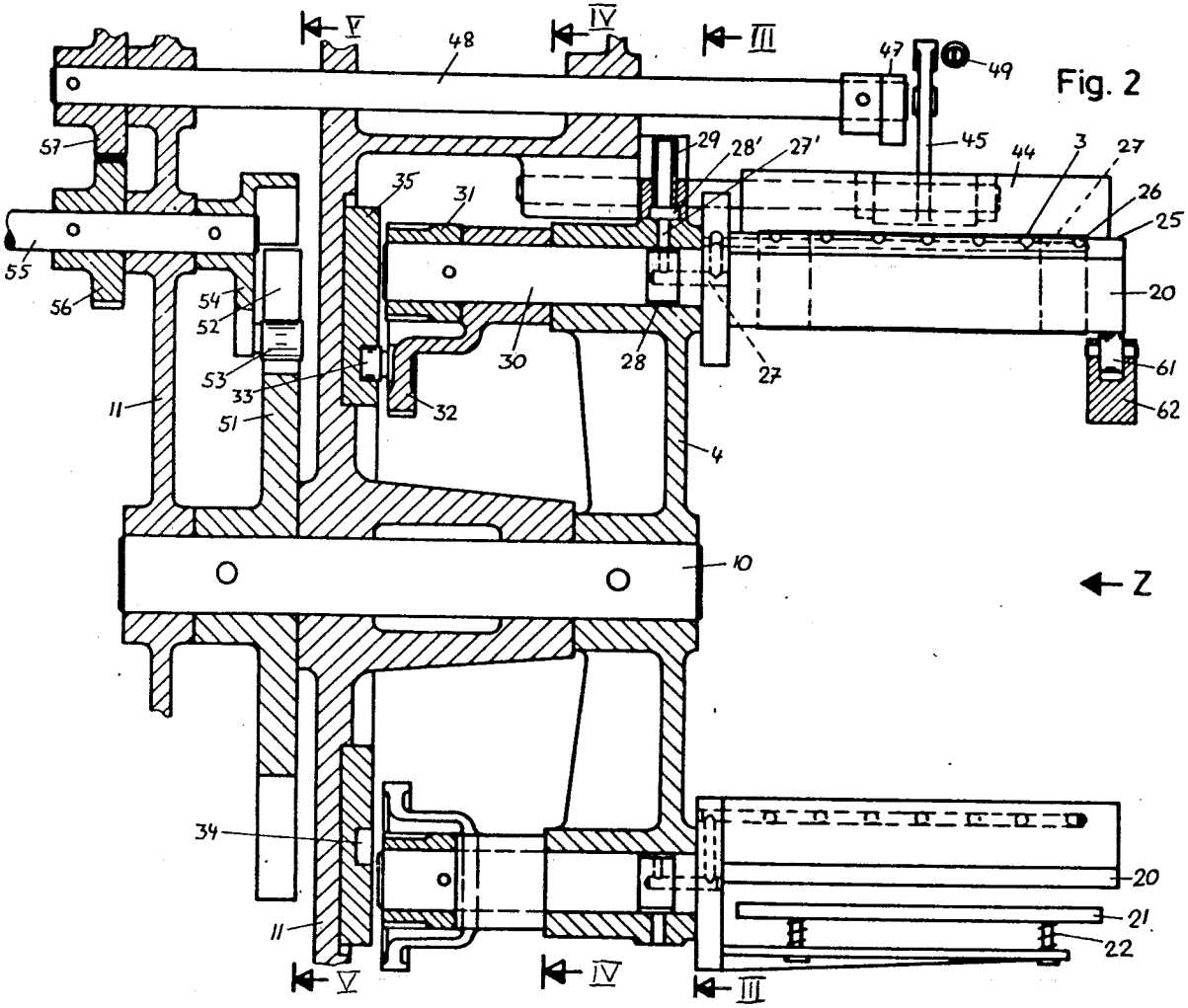
FIG. 2 is a sectional view taken along line II—II of FIG. 1.
Figure 5:
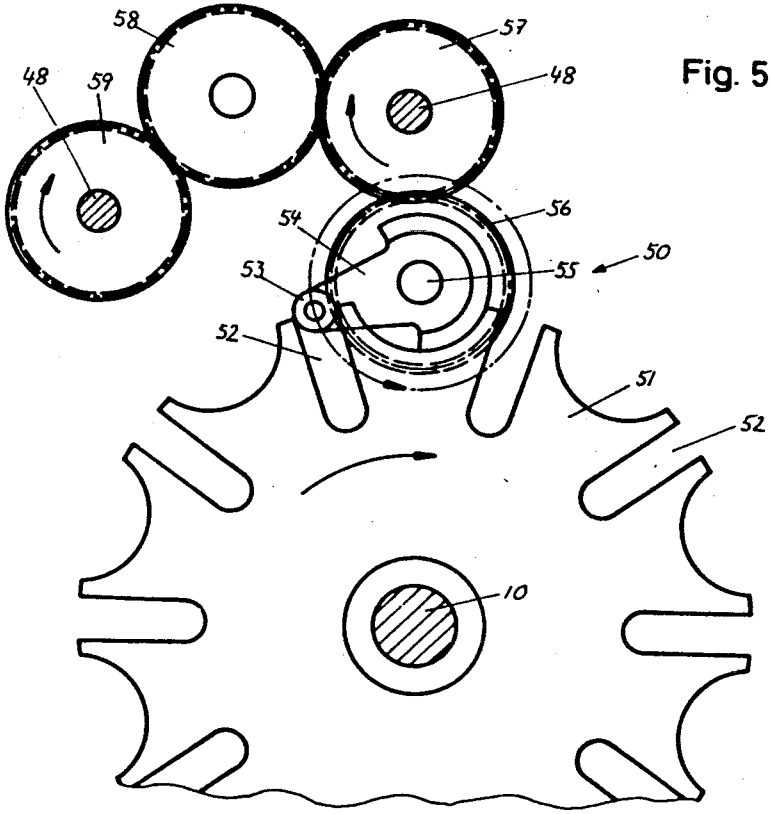
FIG. 5 is a sectional view taken along line V—V of FIG. 2.

Turning to FIGS. 1, 2 and 5, the apparatus generally designated at 1 has a turntable 4 supported on a drive shaft 10 which, in turn, journals in a machine housing 11. The shaft 10 and thus the turntable 4 is driven by a Geneva-type stepping gear 50 including a Geneva gear 51 and a drive roller 53 secured to an end of an arm 54 which, in turn, is rotated by a drive shaft 55 driven by a motor, not shown. The roller 53 periodically and in succession projects into ten radial slots 52 of the Geneva gear 51 and thus stepwise rotates the turntable 4 in increments of 36° in the direction of arrow A.

Figure 6:
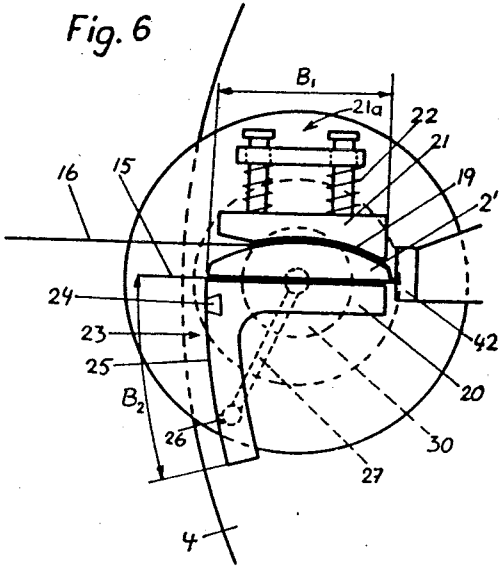
FIG. 6 is an enlarged detail of FIG. 1, including a modification.

On the turntable 4 there are arranged, in a circular circumferential array, ten pockets 5 each designed to receive one article 2. Also referring to FIGS. 4 and 6, each pocket 5 is pivotal about a separate shaft 30 extending parallel to the central shaft 10. Each pocket 5 has a wall 20 rigidly connected with the shaft 30 and a wall 21 oriented parallel to the wall 20 and supported by a bracket 21*a* for reciprocating motion towards and away from the wall 20. The wall 21 is urged in the direction of the wall 20 by springs 22 held in the bracket 21*a*. The wall 20 has an extension 23 which is offset at about 90° relative to the wall 20 and which serves as a countersupport for a sealing mechanism. The countersupport 23 has a flat support face 25 which may be planar as shown in FIG. 1, but which preferably has a cylindrical surface with a radius of curvature approximately corresponding to the radius of the turntable 4, as shown in FIG. 6. As best seen in FIG. 6, in the countersupport 23 there is replaceably embedded an insert 24 made of a thermally insulating and flexible material. As also shown in FIG. 6, for receiving articles 2' which have a convex surface, the wall 21 expediently has a concave face 19.

Figure 4:
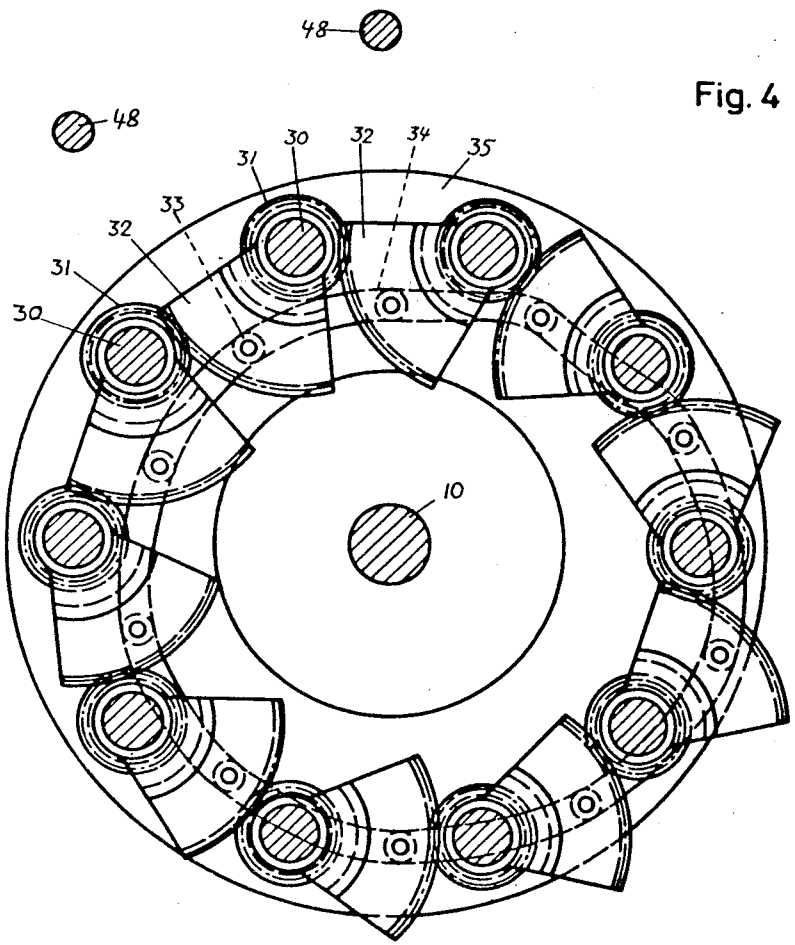
FIG. 4 is a sectional view taken along line IV—IV of FIG. 2.

With particular reference to FIGS. 2 and 4, on the rear terminal portion of the shaft 30 there is affixed a pinion 31 which meshes with a toothed segment 32 relatively rotatably supported on the shaft 30 of an adjoining pocket 5. On the toothed segment 32 there is rotatably supported a roller 33 which is guided in a cam track 34 which determines the angle of rotation of the pocket 5 relative to the turntable 4 during rotation of the latter. The cam track 34 is milled into a replaceable cam disc 35 stationarily mounted on the housing 11, so that the relative motion of the pockets 5 between individual stations may be adapted to operational conditions.

Reverting once again to FIG. 1, in a charging station 6 both walls 20 and 21 of the pocket 5 are oriented at least approximately in a radial direction relative to the rotary axis of the turntable 4. A charging pusher 38 mounted in the charging station 6 pushes an article 2 in the pocket 5 against a stop 42 mounted on the stationary housing 11.

A wrapper piece 3 held between two guides 39 and positioned by an abutment 40 is caught by the leading end of the article 2 and is wrapped around the article 2. In this manner, a relatively wide flap 16 and a relatively narrow flap 15 are formed which project radially beyond the article 2. The latter is, after it is received in the pocket 5, gently clamped between the stationary wall 20 and the movable wall 21 by the force of the springs 22.

Figure 3:
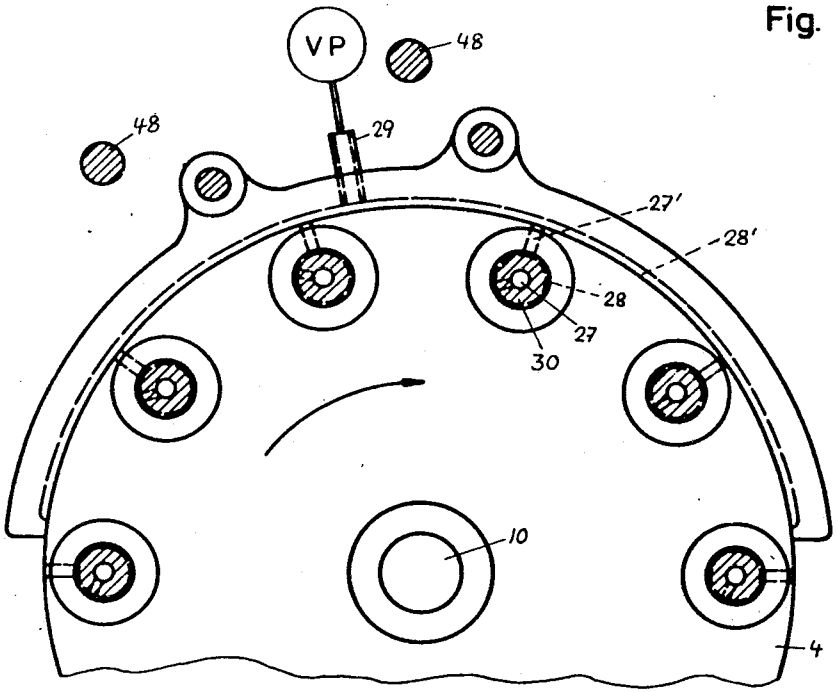
FIG. 3 is a sectional view taken along line III—III of FIG. 2.

Upon further orbital motion of the pocket 5 with the turntable 4 towards a first sealing station 7, a stationary strip 41 lays both flaps 15 and 16 in a superposed manner flat against the support face 25 whose width $B_2$ corresponds to at least $\frac{2}{3}$ of the width $B_1$ of the wall 20 (FIG. 6). The longer flap 16 (which directly engages the face 25) is held firmly by suction applied to vacuum holes 26 provided in the face 25 of the extension 23. Also referring to FIGS. 2 and 3, the holes 26 in each extension 23 are connected to a vacuum nipple 29 of a vacuum pump VP by a channel 27, an annular groove 28 of the respective shafts 30, as well as a radial bore 27' in the turntable 4 and a circumferential groove 28' which extends along a portion of the circumference of the turntable 4 and which is provided in a stationary component of the housing 11.

Referring to FIGS. 1, 2 and 5, the first sealing station 7 comprises a sealing device 43 which has a heatable sealing shoe 44 secured to a terminus of one arm of a pivotal bell crank lever 45. The other arm of the lever 45 carries a follower roller 46 which is pressed by means of a tension spring 49 against an eccentric 47 secured to a shaft 48. Upon rotation of the turntable 4, the sealing shoe 44 is lifted by the eccentric 47 off the insert 24 embedded in the extension 23. The rotary motion of the shaft 48 is synchronized with the Geneva gear drive 50 by connecting the shaft 48 with the drive shaft 55 by means of meshing spur gears 56, 57, 58 and 59.

In the sealing station 7 the hot sealing shoe 44 is pressed by the spring 49 against the flaps 15 and 16 onto the insert 24 of the extension 23 (which, in this operation, serves as a countersupport for the sealing shoe 44), whereupon the seam 17 is formed. In order to be able to maintain the operational periods short and thus increase the output of the apparatus, a second sealing station 8 is provided which has a sealing device 43' being of identical construction as the sealing device 43 of the first sealing station 7.

In order to reduce the risks of buckling of the countersupport 23 at the sealing stations 7 and 8, the wall 20 in both sealing stations is countersupported by rollers 61 which are mounted to a carrier 62 attached to the housing 11.

Upon further orbital motion of the pocket 5 from the second sealing station 8 to the discharge station 9, the pocket 5 is, relative to the turntable 4, turned by the drive including the cam track 34, the follower roller 33, the toothed segment 32 and the pinion 31, through 180° in the direction of arrow B until the walls 20 and 21 are, as before, oriented radially. However, contrary to the position in the stations 6, 7 and 8, where the extension 23 was situated radially outwardly, in the discharge station 9 the extension is, due to the 180° rotation, situated radially inwardly. Consequently, in the discharge station 9 the flaps 15 and 16 are situated at the rear side of the article 2 as viewed in the direction of ejection. An ejector pusher 63 displaces the article 2 radially outwardly into a subsequent apparatus which may have, for example, a turntable 66 with pockets 67 and in which the end closures on the narrow sides of the article may be provided. The long flap 16 projects radially outwardly from the turntable 66 so that, as a result, it may be easily and reliably grasped by grippers and handled to perform the folding operations.

As each pocket 5 orbits from the discharge station 9 to the charging station 6 for restarting the cycle, the pocket 5 is turned 180° in the direction of arrow C relative to the turntable 4, to thus again assume a position in which the extension 23 is oriented radially outwardly.

It will be understood that the above description of the present invention is susceptible to various modifications, changes and adaptations, and the same are intended to be comprehended within the meaning and range of equivalents of the appended claims.

What is claimed is:

1. In a packaging machine including a folding, sealing and conveying apparatus for individually wrapping generally flat, rectangular items in a wrapper sheet; the apparatus including a turntable having a rotary axis; drive means for rotating said turntable in increments; a plurality of pocket assemblies arranged in a circular array on said turntable; each pocket assembly including first and second walls arranged to engage, with respective wall faces, opposite faces of the article for holding the article in the pocket assembly; the apparatus further including a charging station being situated adjacent said turntable and being arranged for introducing, in a direction generally radially inwardly relative to said axis, an article with a wrapper sheet in between said first and second walls of a pocket assembly dwelling in the charging station; a sealing station being situated adjacent said turntable, spaced from said charging station and having a sealing shoe arranged for providing a longitudinal fin seal on superposed flaps of the wrapper sheet; folding means situated between said charging station and said sealing station for superposing said flaps as the respective article, held in the pocket assembly, travels from said charging station into said sealing station; and a discharge station being situated adjacent said turntable, spaced from said charging station and said sealing station and being arranged for ejecting, in a direction generally radially outwardly relative to said axis, an article wrapped in the wrapper sheet, from the pocket assembly dwelling in the discharge station; said wall faces of said first and second walls being oriented radially in said charging station and said discharge station; the improvement comprising (a) an extension affixed to the first wall of each said pocket assembly and being oriented at an angle to said first wall; said extension having a support face cooperating with said folding means and with said sealing shoe as a countersupport therefor for backing up said flaps of said wrapper sheet; and (b) turning means for rotating each said pocket assembly approximately 180° relative to said turntable for setting said extension into a radially relatively outward position in said charging station and a radially relatively inward position in said discharge station.

2. A packaging machine as defined in claim 1, wherein said turning means includes (a) a plurality of carrier shafts rotatably held in said turntable and fixedly supporting each said pocket assembly on said turntable;

(b) a pinion gear keyed to each said carrier shaft;

(c) a toothed segment mounted on each said carrier shaft for rotation relative thereto; the toothed segment on any of said carrier shafts being in a meshing relationship with the pinion on one adjoining said carrier shaft;

(d) a stationary cam track extending generally along a path of travel of said pocket assemblies as the turntable rotates; and (e) follower means mounted on each said toothed segment and engaging said cam track for imparting a rotation to each said toothed segment about the carrier shaft on which it is supported.

3. A packaging machine as defined in claim 1, further comprising means for movably supporting the second wall of each said pocket assembly for displacement towards and away from said first wall and spring means for urging said second wall towards said first wall.

4. A packaging machine as defined in claim 1, wherein the wall face of said second wall is concave for conforming to a convex shape of an article face.

5. A packaging machine as defined in claim 1, wherein said sealing station is a first sealing station; further comprising a second sealing station being situated adjacent said turntable between said first sealing station and said discharge station and having a sealing shoe.

6. A packaging machine as defined in claim 1, wherein each said support face and said wall face of each said first wall have a width; the width of said support face being at least two-thirds the width of the wall face of said first wall.

7. A packaging machine as defined in claim 1, further comprising vacuum means including terminal openings provided in the support face of each said extension, a vacuum source and channel means for maintaining communication between said openings and said vacuum source at least along a portion of a travelling path of each pocket assembly between the charging station and the discharge station.

8. A packaging machine as defined in claim 1, wherein said support face of the extensions is cylindrical.

9. A packaging machine as defined in claim 8, wherein said turntable has a radius and further wherein each cylindrical support face has a radius of curvature generally equalling the radius of said turntable.

10. A packaging machine as defined in claim 1, further comprising a replaceable insert mounted on the support face of each said extension; said insert having an insert face cooperating with said sealing shoe.

11. A packaging machine as defined in claim 10, wherein said insert face is flush with said support face on which it is mounted.

12. A packaging machine as defined in claim 1, further comprising stationary backup means for countersupporting each said extension in said sealing station.

13. A packaging machine as defined in claim 12, wherein said stationary backup means includes a roller for engaging said extensions.

* * * * *